US010065094B2

(12) United States Patent
Wallin

(10) Patent No.: US 10,065,094 B2
(45) Date of Patent: Sep. 4, 2018

(54) GOLF CLUB HEAD

(71) Applicant: Wilson Sporting Goods Co., Chicago, IL (US)

(72) Inventor: Gavin Wallin, Eagle Mountain, UT (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 15/276,473

(22) Filed: Sep. 26, 2016

(65) Prior Publication Data

US 2018/0056154 A1 Mar. 1, 2018

Related U.S. Application Data

(60) Provisional application No. 62/379,207, filed on Aug. 24, 2016.

(51) Int. Cl.
*A63B 53/04* (2015.01)
*A63B 60/02* (2015.01)

(52) U.S. Cl.
CPC ..... *A63B 60/02* (2015.10); *A63B 53/0466* (2013.01); *A63B 2053/0433* (2013.01); *A63B 2053/0491* (2013.01)

(58) Field of Classification Search
CPC ..... A63B 53/0466
See application file for complete search history.

(56) References Cited

U.S. PATENT DOCUMENTS

| | | | | |
|---|---|---|---|---|
| 2,163,091 | A | 6/1939 | Held | |
| 2,517,245 | A | 8/1950 | Scott | |
| 3,466,047 | A | 9/1969 | Rodia et al. | |
| 4,043,563 | A * | 8/1977 | Churchward | A63B 53/08 473/338 |
| 4,085,934 | A | 4/1978 | Churchward | |
| 5,050,879 | A | 9/1991 | Sun et al. | |
| 5,911,638 | A | 6/1999 | Parente et al. | |
| 5,997,415 | A | 12/1999 | Wood | |
| 6,126,556 | A | 10/2000 | Hsieh | |
| 6,259,627 | B1 * | 7/2001 | Wong | G11C 11/5621 365/185.03 |
| 6,306,048 | B1 | 10/2001 | McCabe et al. | |
| 6,348,014 | B1 * | 2/2002 | Chiu | A63B 53/065 473/337 |
| 6,386,990 | B1 | 5/2002 | Reyes et al. | |
| 6,406,381 | B2 | 6/2002 | Murphy et al. | |
| 6,527,650 | B2 | 3/2003 | Reyes et al. | |
| 7,153,220 | B2 | 12/2006 | Lo | |
| 7,166,041 | B2 | 1/2007 | Evans | |
| 7,318,782 | B2 | 1/2008 | Imamoto et al. | |

(Continued)

*Primary Examiner* — Michael Dennis
(74) *Attorney, Agent, or Firm* — Terence P. O'Brien; Todd A. Rathe

(57) ABSTRACT

A golf club head may include a body and a sole plate. The body may include a hosel portion, a front strike face, a crown and a sole. The sole may include a floor and sidewalls extending from the floor to the crown. The sole may include weight ports for receiving weighted slugs. The sole plate may be rotatably mounted to the sole, wherein the sole plate is rotatable, while remaining mounted to the sole, between a cover position in which the sole plate covers each of the weight ports and at least one access position in which each and every weighted port is accessible for removal or insertion of a weighted slug.

15 Claims, 15 Drawing Sheets

(56) References Cited

U.S. PATENT DOCUMENTS

| | | | | |
|---|---|---|---|---|
| 7,344,452 | B2 | 3/2008 | Imamoto et al. | |
| 7,347,795 | B2 | 3/2008 | Yamagishi et al. | |
| 7,438,649 | B2 | 10/2008 | Ezaki et al. | |
| 7,824,280 | B2 | 11/2010 | Yokota | |
| 7,993,216 | B2 | 8/2011 | Lee | |
| 8,192,303 | B2 | 6/2012 | Ban | |
| 8,414,422 | B2 | 4/2013 | Peralta et al. | |
| 8,425,348 | B2 * | 4/2013 | Boyd | A63B 53/0466 473/335 |
| 8,579,724 | B2 | 11/2013 | Evans | |
| 8,608,591 | B2 | 12/2013 | Chao et al. | |
| 8,702,533 | B2 | 4/2014 | Evans | |
| 8,721,472 | B2 | 5/2014 | Kuan et al. | |
| 8,814,722 | B2 | 8/2014 | Stites et al. | |
| 8,888,607 | B2 | 11/2014 | Harbert et al. | |
| 8,900,069 | B2 | 12/2014 | Beach et al. | |
| 8,915,797 | B1 | 12/2014 | Kuhar et al. | |
| 8,926,449 | B2 | 1/2015 | Sato | |
| 8,938,871 | B2 | 1/2015 | Roach et al. | |
| 8,951,145 | B2 | 2/2015 | Bezilla et al. | |
| 8,979,671 | B1 | 3/2015 | DeMille et al. | |
| 9,011,269 | B2 | 4/2015 | Billings | |
| 9,033,813 | B2 | 5/2015 | Oldknow et al. | |
| 9,072,949 | B2 | 7/2015 | Stites et al. | |
| 9,101,811 | B1 | 8/2015 | Goudarzi et al. | |
| 9,457,245 | B2 | 10/2016 | Lee | |
| 9,468,820 | B2 | 10/2016 | Sugimoto | |
| 2002/0128089 | A1 | 9/2002 | Sillers et al. | |

* cited by examiner

GOLF CLUB HEAD

CROSS-REFERENCE TO RELATED PATENT APPLICATIONS

The present application is a non-provisional application claiming priority from U.S. Provisional Patent Application Ser. No. 62/379,207 filed on Aug. 24, 2016 by Gavin Wallin and entitled GOLF CLUB HEAD, the full disclosure of which is hereby incorporated by reference.

FIELD OF THE DISCLOSURE

The present disclosure relates generally to a golf club head for a golf club.

BACKGROUND

Golf is a sport enjoyed by golfers of all ages and skill levels. Golfers at all levels continually strive to improve their game. One approach that many golfers use to improve their play is to customize their clubs to fit their game. Golf presents many challenges to golfers. For example, many golfers find their game changing over time. Additionally, golf courses present a variety of challenging holes that provide golfers the opportunity to use golf clubs of varying features and/or characteristics to best meet such challenges. As a result, golfers require a variety of different clubs to meet these challenges.

Although golfers may desire a large number of different clubs for their game, many practical considerations can prevent golfers from meeting this need. The 14 club rule in the Rules of Golf limits the number of clubs golfers can carry. Players, who prefer to carry their bags, often prefer to limit the number of clubs they carry to make the round more enjoyable and carrying their golf bag less burdensome. Another consideration is cost. Although players may desire three different drivers having different characteristics, many golfers simply can't justify the expense of purchasing such clubs.

Thus, a continuing need exists for a golf club that can be easily, simply and conveniently adjusted to obtain different golf club characteristics. What is needed is a golf club that performs well, and allows for the player to quickly and easily adjust the club head to match the golfer's particular needs or objectives at that time. There is a need for a club head that can be readily adjusted into a variety of different settings thereby eliminating the need for the golfer to carry multiple clubs to meet the different desired settings. Further, there is a need for a golf club that meets these needs while also providing an improved, pleasing aesthetic.

SUMMARY

A golf club head may include a body and a sole plate. The body may include a hosel portion, a front strike face, a crown and a sole. The sole may include a floor and sidewalls extending from the floor to the crown. The sole may include weight ports for receiving weighted slugs. The sole plate may be rotatably mounted to the sole, wherein the sole plate is rotatable, while remaining mounted to the sole, between a cover position in which the sole plate covers each of the weight ports and at least one access position in which each and every weighted port is accessible for removal or insertion of a weighted slug.

A golf club head may include a body and a sole plate. The body may include a hosel portion, a front strike face, a crown, and a sole. The sole may include a floor and sidewalls extending from the floor to the crown, wherein the floor comprising weight ports for receiving weighted slugs. The weight ports may include a first cluster of weight ports proximate the front strike face on a first side of the axis, wherein the weight ports of the first cluster having a first spacing in a direction along the front strike face. The weight ports may further include a second cluster of weight ports on a second side of the axis opposite the first side, wherein the second cluster of weight ports having a second spacing in the direction along the front strike face, the second spacing being greater than the first spacing. The sole plate may be movably mounted to the sole for movement between a cover position in which the sole plate covers each of the weight ports and at least one access position in which each and every weighted port is accessible for removal or insertion of a weighted slug.

A golf club head may include a body, a set of weight slugs and a sole plate. The body may include a hosel portion, a front strike face, a crown, and a sole. The sole may include a floor and sidewalls extending from the floor to the crown, wherein the floor may include weight ports for receiving weighted slugs. Each weight plug of the set of weight plugs may be receivable within at least one of the weight ports. Each weight slug may include a slug body and an elastomeric gasket on an exterior of the slug body to grip a first interior surface of one of the weight ports at a depth when received within said one of the weight ports. The sole plate may be movably mounted to the sole for movement between a cover position in which the sole plate covers each of the weight ports and at least one access position in which each and every weighted port is accessible for removal or insertion of a weighted slug.

DETAILED DESCRIPTION OF EXAMPLE EMBODIMENTS

Figure 1:
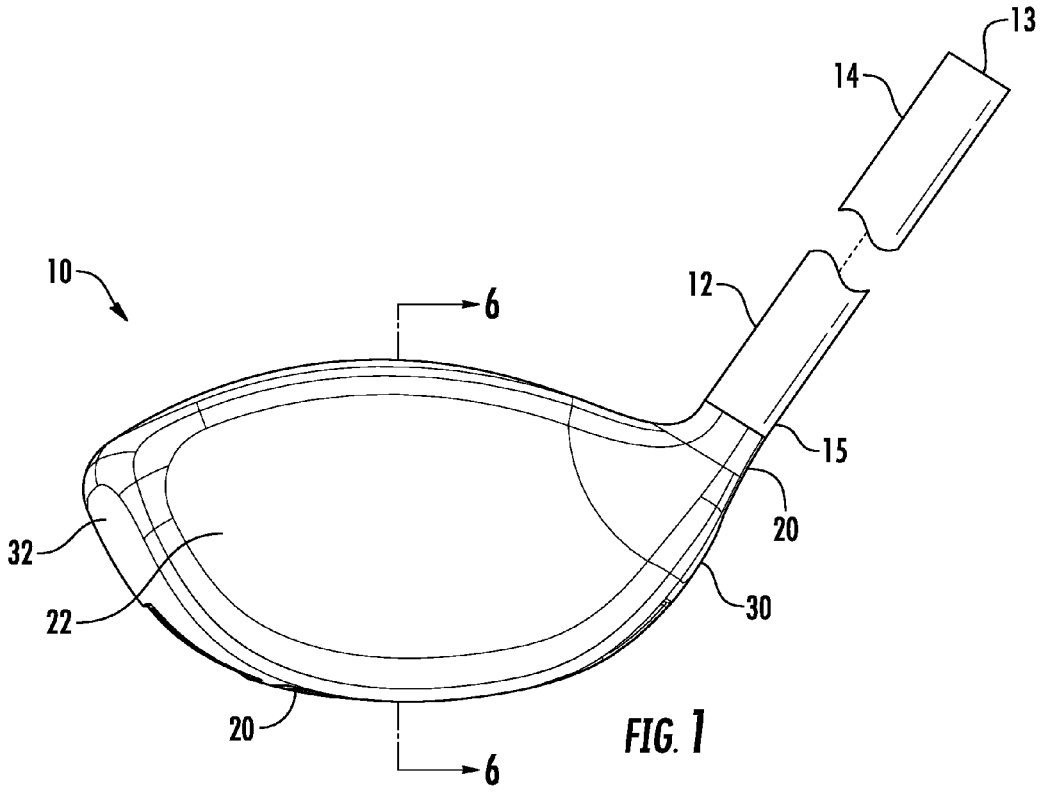
FIG. 1 is a front view of an example golf club having a head.
Figure 2:
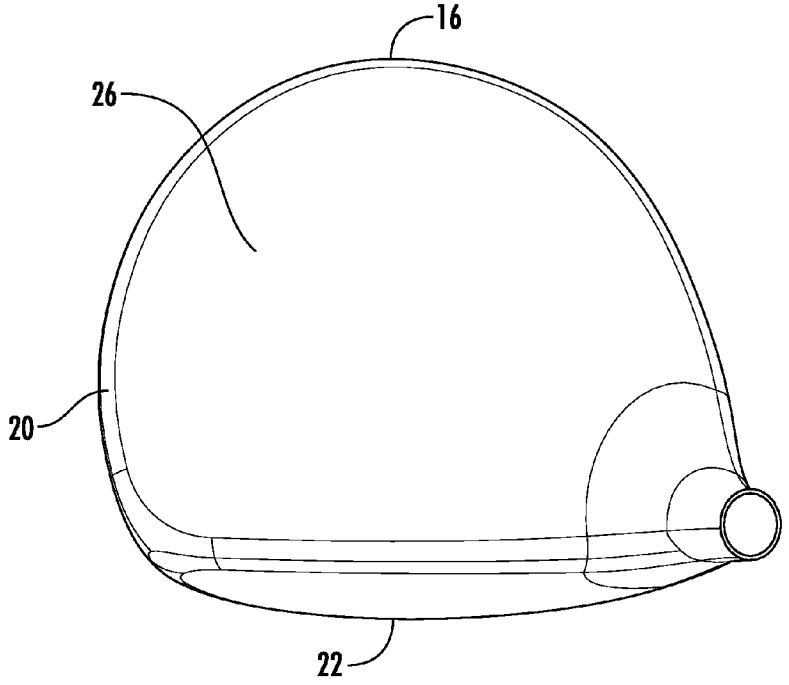
FIG. 2 is a top view of the example golf club head of FIG. 1.
Figure 3:
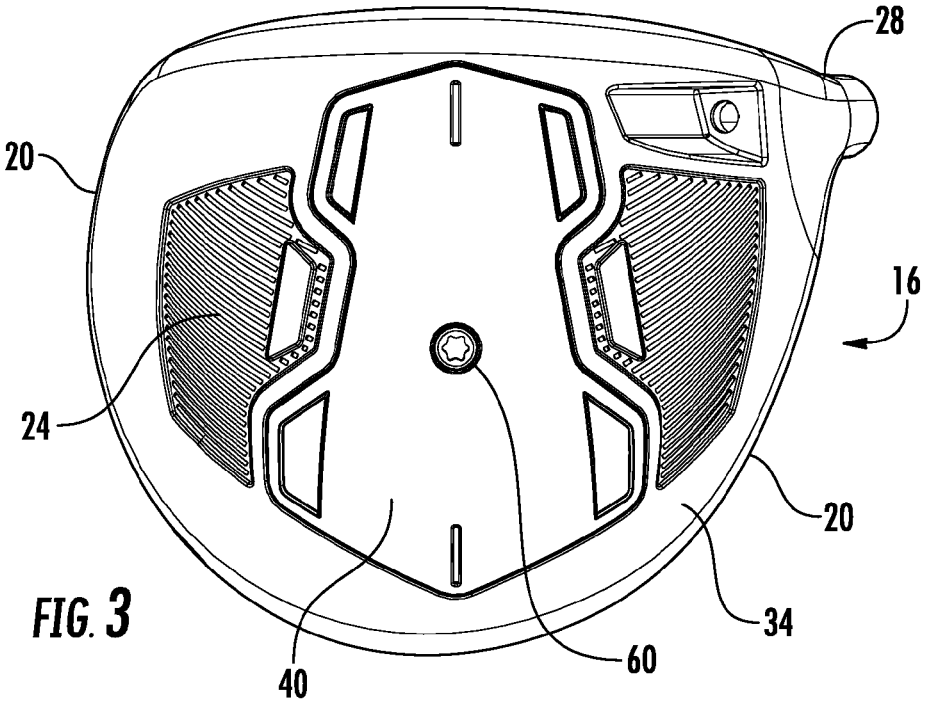
FIG. 3 is a bottom view of the example golf club head of FIG. 1.
Figure 4:
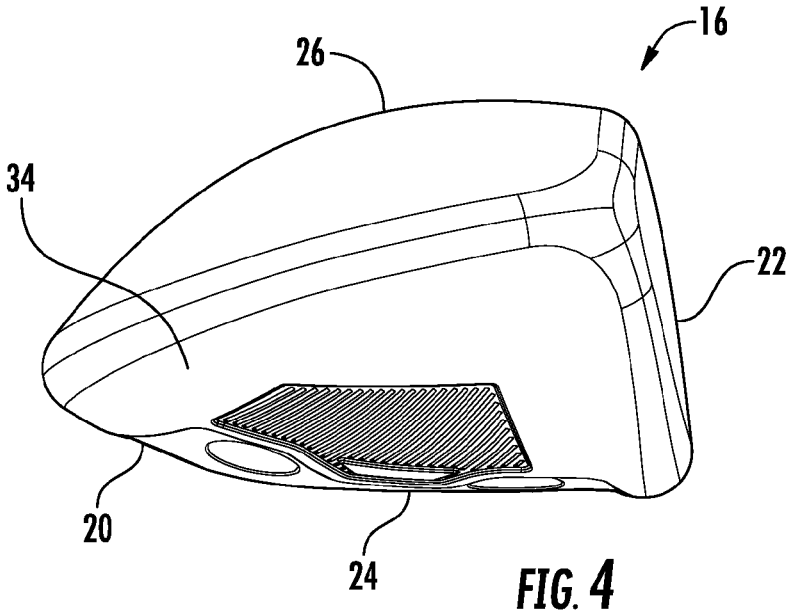
FIG. 4 is a toe end view of the golf club head of FIG. 1.
Figure 5:
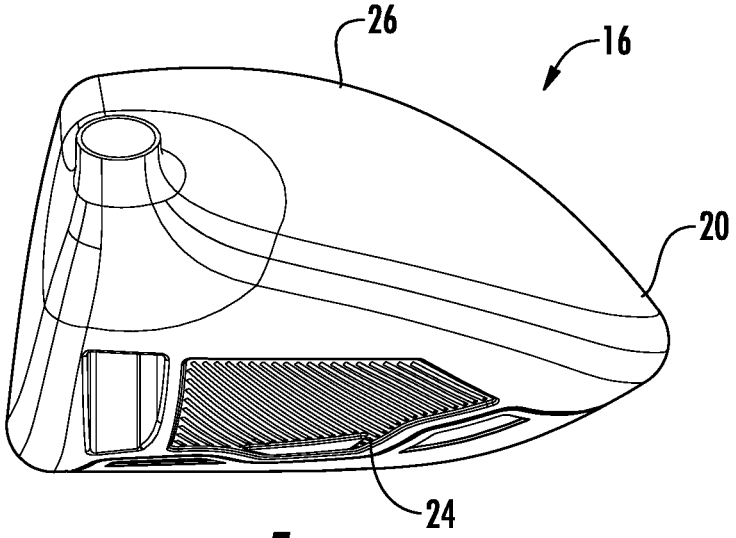
FIG. 5 is a heel end view of the golf club head of FIG. 1.
Figure 6:
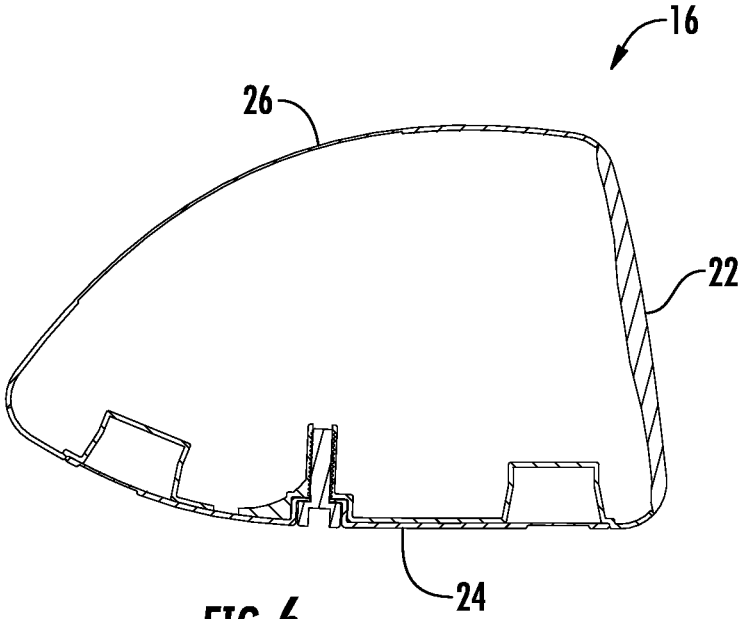
FIG. 6 is a longitudinal cross-sectional view of the example golf club head of FIG. 1 taken along line 6-6.

FIGS. 1-7 illustrate an example golf club 10. The example golf club 10 of FIG. 1 is configured as a driver. Although the features of golf club 10 are illustrated with respect to a driver, the same features are also directly applicable to, fairway woods and combinations thereof in sets of golf clubs. The golf club 10 is an elongate implement configured for striking a golf ball and includes a golf shaft 12 having a butt end 13 with a grip 14 and a tip end 15 coupled to a club head 16.

The shaft 12 is an elongate hollow tube extending along a first longitudinal axis. The shaft 12 tapers toward the tip end 15. The shaft 12 is formed of a lightweight, strong, flexible material, preferably as a composite material. In alternative embodiments, the shaft 12 can be formed of other materials such as, other composite materials, steel, other alloys, wood, ceramic, thermoset polymers, thermoplastic polymers, and combinations thereof. The shaft can be formed as one single integral piece or as a multi-sectional golf shaft of two or more portions or sections.

As used herein, the term "composite material" refers to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly preferred embodiments, the number layers can range from 3 to 8. In multiple layer constructions, the fibers can be aligned in different directions with respect to the longitudinal axis 18, and/or in braids or weaves from layer to layer. The layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon or thermoplastic materials. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, Kevlar®, Spectra®, poly-para-phenylene-2, 6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers.

FIGS. 2-8 illustrate the example golf club head 16 in more detail. As shown by FIGS. 2-8, golf club head 16 comprises body 20, removable and/or pivotable sole plate 40 and removable weight slugs 46 (shown removed from body 20, along with sole plate 40, in FIG. 8). Body 20 comprises a hollow structure that is coupled to the shaft 12. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another.

In one implementation, the body 20 of the club head 16 can be formed as a single unitary, integral body through a combination of casting and welding. In another implementation, the club head 16 can be formed through a combination of forging and welding. In other implementations, the components of the body 20 of the club head 16 can be formed through casting, forging, welding, molding or a combination thereof. In one implementation, the body 20 of the club head 16 is made of a high tensile strength, durable material, preferably a stainless steel or titanium alloy. Alternatively, the body 20 of the club head 16 can be made of other materials, such as, for example, a composite material, aluminum, other steels, metals, alloys, wood, ceramics or combinations thereof.

The body 20 of the club head 16 comprises a generally vertical front striking plate or strike face 22, a sole 24, a crown 26 and a hosel portion 28. The striking plate 22 extends from a heel portion 30 to a toe portion 32 of the club head 10. The sole 24 and the crown 26 rearwardly extend from lower and upper portions of the striking plate 22, respectively. The sole 24 generally curves upward to meet the generally downward curved crown 26. The portion of the sole 24 adjacent the crown 26 that connects the sole 24 to the crown 26 at perimeter locations other than at the striking plate 22 can be referred to as a side wall 34 or skirt.

Figure 7:
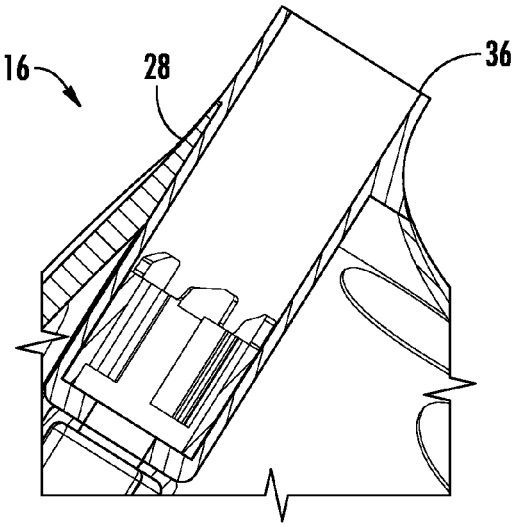
FIG. 7 is a cross-sectional view of a hosel of the golf club head of FIG. 1.

As shown by FIG. 7, the hosel portion 28 is a generally cylindrical body that upwardly extends from the crown 26 at the heel portion 30 of the club head 16 to couple the club head 16 to the shaft 12. The hosel portion 28 defines an upper hosel opening 36 for receiving the tip end 15 of the shaft 12.

Figure 8:
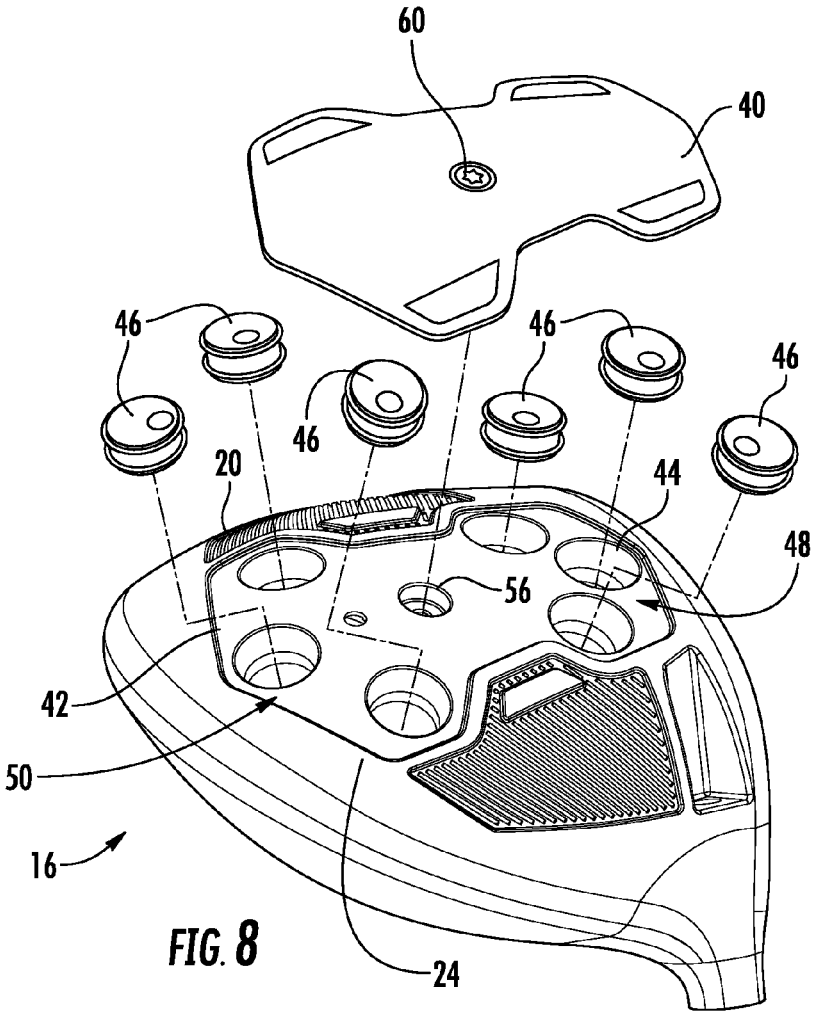
FIG. 8 is an exploded bottom perspective view of a portion of the golf club head of FIG. 1.

As shown by FIG. 8, the sole 24 of the body 20 is formed with a recessed region or recess 42 and a set of weight ports 44 extending into the body of the club head 16. Each of weight ports 44 is sized to receive a removable weight slug 46. In the example illustrated, each of weight ports 44 is cylindrical. In other implementations, each of weight ports 44 may have other shapes, such as oval or polygonal shapes. In one implementation, the weight ports 44 each have a diameter of at least 10 mm and a depth of at least 20 mm. In another implementation, the weight ports 44 have a diameter of at least 20 mm and a depth of at least 40 mm. In other implementations, the weight ports can have other dimensions or combinations of dimensions. The weight ports 44 are sized to removably receive one of the weight slugs 46 from the set of weighted slugs 46.

In the example illustrated, the weight ports 44 number at least four. In another implementation, the weight ports number at least 6. In other implementations, the weight ports can number 5, 7, 8 or more. In one implementation, the weight ports 44 are arranged into a forward group or cluster 48 generally positioned on the sole 24 so as to be closer to the striking face 22 of the body 20, and a rearward group or cluster 50 positioned closer to the rear of the body 20. The forward and rearward clusters 48 and 50 enable the user to position one or more of the weighted slugs 46 closer to the striking face 22, to the rear of the club head, toward the heel side, toward the toe side, or generally evenly distributed. The club head 16 can also be used without any of the weight slugs 46.

As further shown by FIG. 8, the sole 24 includes a central bore 56 for receiving a sole plate coupling member 60. In one implementation, the sole plate coupling member 60 is a threaded fastener 62 and a washer 64 (see FIG. 12). The central bore 56 can include a threaded bore for receiving the fastener 62. The fastener 62 and the bore 56 are sufficiently sized to enable the fastener 62 to be loosened and unthreaded from the bore 56 by several revolutions without the fastener 62 separating or losing threaded engagement with the bore 56. The partially removed or partially unthreaded fastener 62 enables a sole plate 40 to be repositioned about the sole 24 of the body 20 such that one or more of the weight ports 44 and one or more of the weighted slugs 46 are selectively accessible for removal and/or insertion of one or more of the weighted slugs 46 into one or more different weight ports 52. The fastener 62 and bore 56 also enables the sole plate 40 to pivot about an axis 169 (see FIG. 20) defined by the fastener 62 and reposition the sole plate 40 into a second position that is rotated 180 degrees (or any degree of rotation desired by the user) from the original sole plate position.

Sole plate 40 comprises a plate that covers weight ports 44 and that is movable to provide access to weight ports 44 for the selectable insertion or removal of weight slugs 46. In the example illustrated, sole plate 44 is removable from sole 24, uncovering and exposing all of the weight ports 44 in sole 24. In another implementation, sole plate 44 is permanently mounted or attached to sole 24, not being separable from sole 44 without permanent damage to the components of golf club head 16. As will be described hereafter, in one implementation, sole plate 44, whether removably mounted to, or permanently mounted to, sole 24, is rotatable, while remaining coupled to sole 24, between a cover position in which sole 24 covers or extends over (or beneath) weight ports 44 and at least one access position in which sole plate 44 does not cover one or more of the weight ports 44, allowing weight slugs 46 to be inserted into or removed from each of the weight ports 44.

In one implementation the removable sole plate 40 can be formed of a composite material. In another implementation, the sole plate 40 can be formed of an alloy, such as a titanium alloy or an aluminum alloy. In other implementations, the removable sole plate can be formed of other alloys, other metals, a composite/metal hybrid, a plastic, a ceramic, wood or combinations thereof.

In one implementation, the club head 16 can be produced with a single removable sole plate 40. In another implementation, the club head 16 can be sold or configured with one or more extra or spare sole plates. In one implementation, the club head 16 can be supplied with one, two, three or more sole plates, wherein each of the sole plates is interchangeable with one another. The sole plates 40 can have different weights, different textures, different colors, different graphics, different indicia and combinations thereof. In another implementation, the sole plate 40 can be formed of a transparent or translucent material enabling the weight ports 44 and/or weight slugs 46 to be visible to the user with the sole plate the cover position secured to the sole 24.

Figure 9:
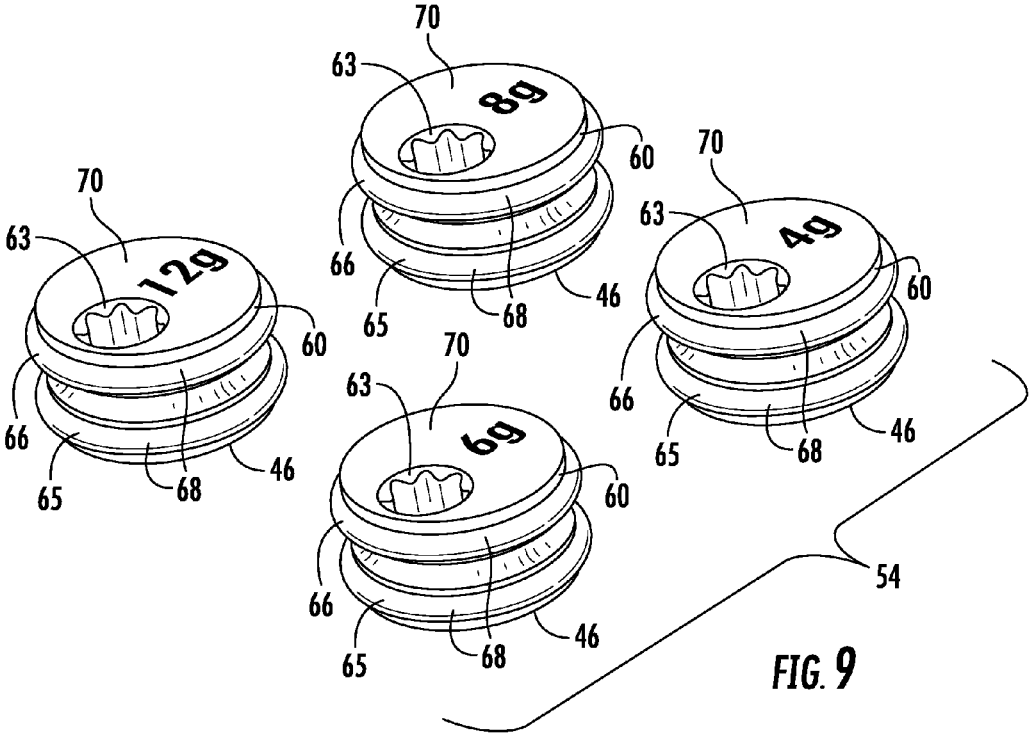
FIG. 9 is a bottom side perspective view of an example set of weight slugs for use in the example golf club head of FIG. 1.

Referring to FIGS. 8 and 9, weight slugs 46 comprise individual weighted masses or units to be removably positioned within weight ports 44. The weight slugs 46 can have a weight within the range of 1 gram to 20 grams. In one implementation, each weight slot 46 has a weight within the range of 2 to 12 grams. In one implementation the club head 16 can include 3 weight slugs 46 and each weight slug 46 may have the same weight. Alternatively, the set of 3 weight slugs 46 can include two weight slugs 46 of the same weight and the third slug of a different weight. In another implementation, each of the three weight slugs 46 can be different weights. In other implementations, the club head can be configured with 2, 4, 5, 6, or more weight slugs 46. The one or more extra or spare weight slugs 46 can provide the user with greater flexibility in adjusting the overall weight of the club head, and the weight distribution or configuration of the club head. The weight slugs 46 are formed of one or more alloys. In other implementations, the weights can be formed of a heavy metal, other alloys, and combinations thereof.

FIG. 9 illustrates an example set 54 of example weight slugs 46 for being provided as part of golf club head 16 or another golf club head having weight ports 44. As shown by FIG. 9, each of weight slugs 46 comprises a slug body 60, a detent 63 and a pair of axially spaced gaskets 65, 66. Body 60 provides a mass for and is sized and shaped to be received within any of weight ports 44 (shown in FIG. 8). In the example illustrated, body 60 has a cylindrical shape. In other implementations, body 60 may have other shapes. In the example illustrated, body 60 comprises one or more annular grooves 68 for retaining one or both gaskets 65, 66.

Detent 63 extends into a top or upper face 70 of body 60. Detent 63 provides a surface irregularity by which each slug 46 may be gripped when the particular weight slug 46 is to be removed from the interior of a weight port 44. In the example illustrated, each detent 63 is eccentric with respect to a center centerline of weight slug 46 to facilitate removal of slug 46. The detent 63 enables the weight slugs 46 to be removed with a weight removal tool (not shown). Detent 63 provides a user with the ability to grasp and remove slot 46 without protuberances, allowing face 70 of body 60 to be substantially flush with ceiling/floor of recess 42. In other implementations, each slug 46 may alternatively comprise a tab or projection to facilitate gripping and removal of slug 46 from a receiving weight port 44. In still other implementations, detent 63 may be omitted.

Gaskets 65, 66 comprise elastomeric structures positioned about a perimeter surface of body 60 so as to frictionally engage and grip interior side surfaces of a receiving weight port 44. Gaskets 65, 66 assist in retaining slug 46 within weight port 44 and further assist in reducing noise and vibration that might otherwise result from the interaction of weight slug 46 with the interior of weight port 44 or sole plate 40. Gaskets 65, 66 are vertically spaced from one another such a gasket 65, 66 grip different interior surfaces of weight port 44 at different depths when slug 46 received within the weight port 44. As a result, the actual or vertical spacing of gasket 65, 66 further enhances the reduction of noise and vibration that might otherwise occur due to interaction between slug 46 and body 20.

In the example illustrated, gaskets 65, 66 each comprise rubber, synthetic rubber or otherwise elastomeric O-rings received and retained within grooves 68. Gaskets 65, 66 circumscribe body 68, providing an elastomeric or resiliently compressible annular surface that continuously extends about the entire perimeter of body 60. In other implementations, gasket 65, 66 may alternatively comprise an annular ring completely received within the respective groove 68, wherein each gaskets 65, 66 comprises circumferentially spaced rubber-like or elastomeric tabs, knobs or other projections radially extending from the annular ring into frictional engagement with the interior surfaces of the receiving weight port 44. In still other implementations, grooves 68 may be omitted, wherein gaskets 65, 66 are bonded or mechanically interlocked with body 60 for retention. In some implementations, slugs 46 may include greater than the two illustrated gasket 65, 66 or may include a single gasket. In some implementations, grooves 68 and gasket 65, 66 may be omitted. In another implementation, one or more of the weight slugs can include a single gasket. In another implementation, one or more of the weight slugs can include three or more gaskets. In yet another implementation, one or more of the weights can be formed with an elastomeric sleeve to facilitate engagement of the weigh slugs with the weight ports.

Figure 10:
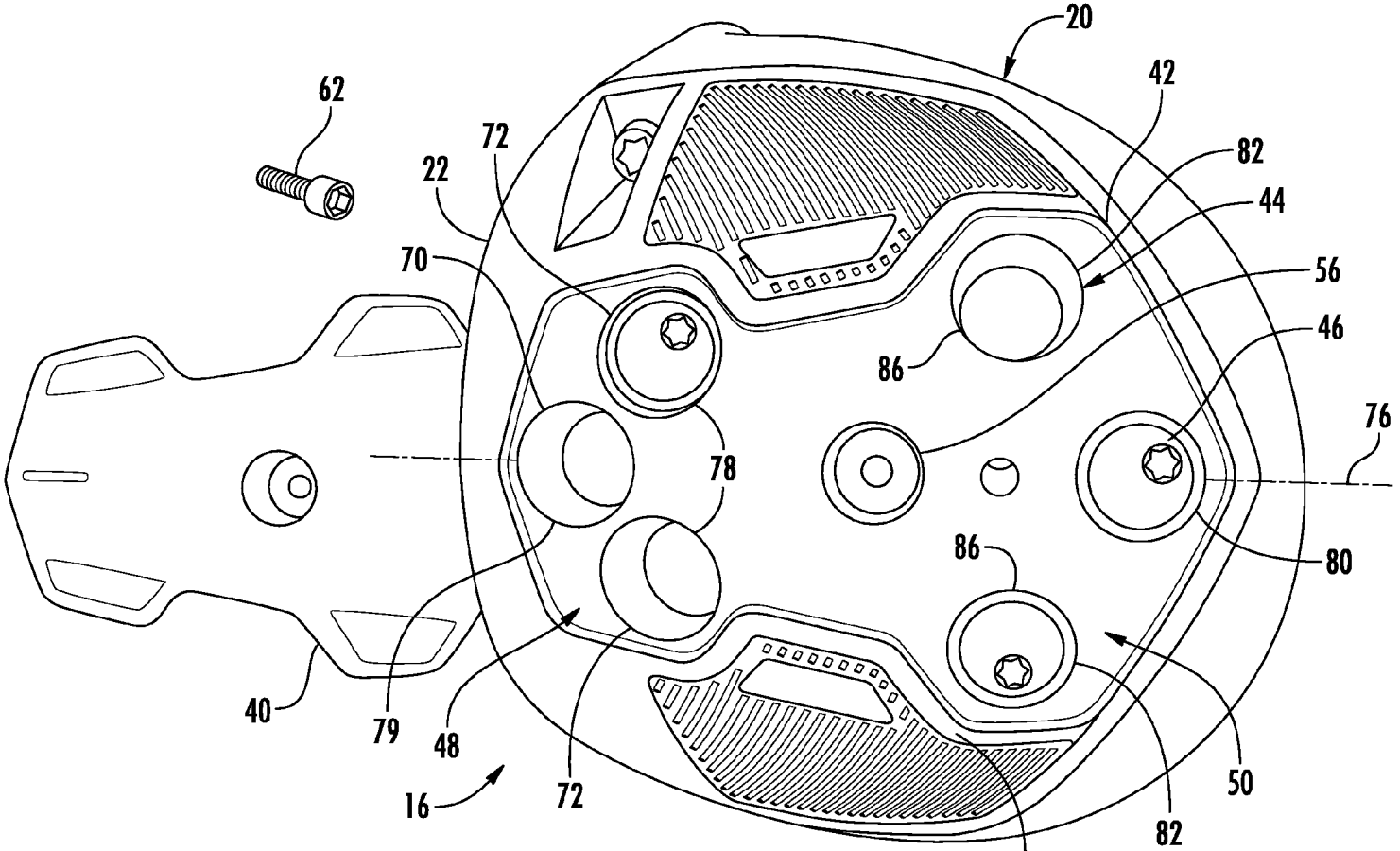
FIG. 10 is a bottom view of the golf club head of FIG. 1 with the sole plate removed illustrating the first example arrangement of example weight slugs in example weight ports.
Figure 11:
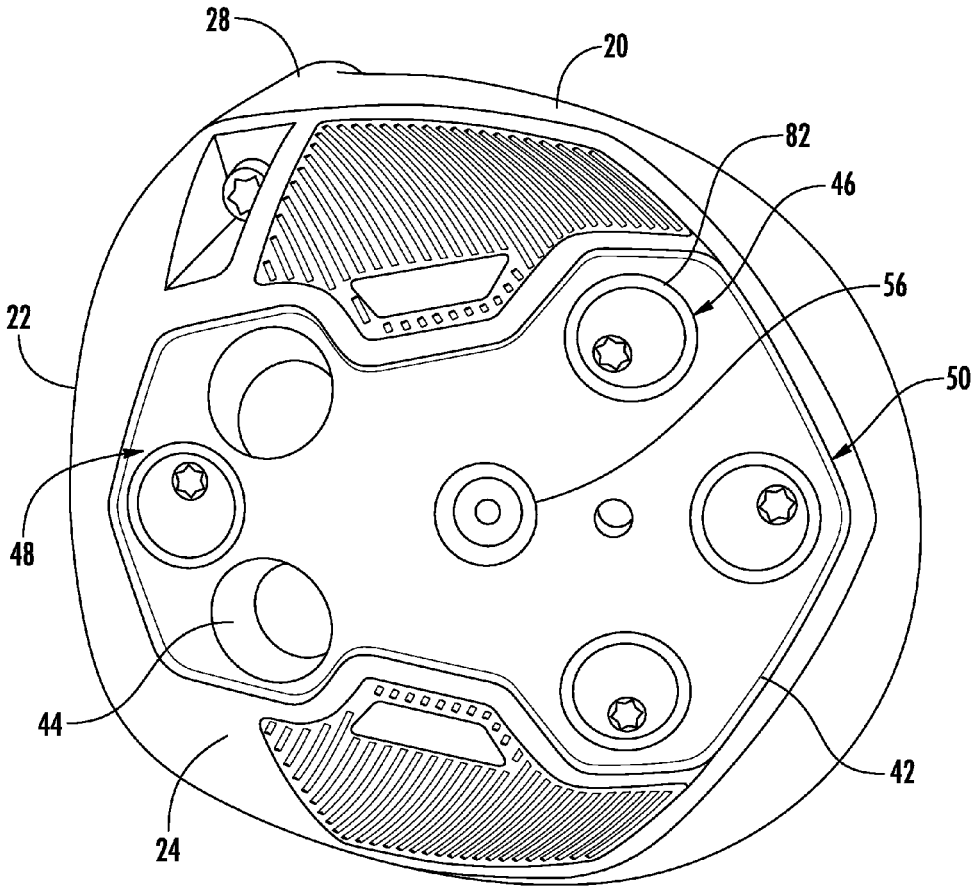
FIG. 11 is a bottom view of a portion of the golf club head of FIG. 1 illustrating the second example arrangement of example weight slugs in example weight ports.

FIGS. 10 and 11 illustrate sole plate 40 removed from sole 24 to illustrate the example layout of weight ports 44 in more detail. FIGS. 10 and 11 further illustrate one example arrangement of weight slugs 46 in weight ports 44 of body 16. As mentioned above, in the example illustrated, weight ports 44 are arranged into two groups or clusters: a forward cluster 48 and a rearward cluster 50. Forward cluster 48 comprises a center weight port 70 and a pair of side weight ports 72. Center weight port 70 extends proximate to front face strike face 22 and is centered along a longitudinal centerline 76 of body 20, the longitudinal centerline 76 extending substantially perpendicular to the front strike face 22.

Side weight ports 72 are rearward of center weight port 70 while being laterally offset from center weight port 70 on opposite sides of centerline 76. Each of side weight port 72 has a perimeter 78 that overlaps the outer perimeter 79 of weight port 70 in a lateral direction, perpendicular to longitudinal centerline 76. This compact arrangement of center weight port 70 and side weight ports 72 provide forward cluster 48 with a tight, high density arrangement of ports that facilitates positioning of weight slugs 46 in close proximity to and along the front strike face 22.

Rearward cluster 50 comprises a center weight port 80 and two side weight ports 82. Center weight port 80 is positioned proximate to a tail or rear and of body 20. As with center weight port 70, center weight port 80 is centered along a longitudinal centerline 76 of body 20.

Side weight ports 82 are laterally offset from port 80 on opposite sides of centerline 76. Each of side weight ports 82 has an outer perimeter 86 that is in an overlapping relationship with respect to the outer perimeter 78 of side ports 72 in the longitudinal direction, in a direction parallel to longitudinal centerline 76. In the example illustrated, each of side weight ports 82 lies at least partially outside of side weight port 72 with respect to centerline 76. In other words, side weight ports 82 are further spaced from partial centerline 76 as compared to side weight port 72. As a result, rear cluster 50 of weight ports 44 have a greater inter-port spacing as compared to weight ports 44 of forward cluster 48. This greater spacing allows the weight selectively provided by weight slugs 46 to be less concentrated, more dispersed, along the rear or tail of body 20, away from strike face 22. The potential wider dispersion of weight at the rear may enhance stability of golf club had 16.

FIG. 10 illustrates one arrangement of weight slugs 46 within weight ports 44. In the example illustrated, center weight slug 80, side weight port 82 towards the toe of head 16 and side weight port 72, towards the heel of head 16 receive weight slugs 46. In one implementation, the weight slugs that are received are the same in weight and weight characteristics. In other implementations, the received weight slugs may have different weights or different weight distribution characteristics.

FIG. 11 illustrates another example arrangement of weight slugs 46 within weight ports 44. In the example shown in FIG. 11, the side weight port 82 proximate to the heel of body 20 is additionally provided with a weight slug 46. In one implementation, the two side weight ports 82 receive weight slugs 46 having different weights. As should be appreciated, a user may selectively provide weight slugs 46 in any, none, or all of weight ports 44 to accommodate his or her customization preferences. Some weight ports 44 may be left empty while others are filled with slugs 46. Different weight ports 44 may contain slugs having different weights or different weight distribution characteristics. Ports 44 and slugs 46 allow a user to optimize weight distribution characteristics of club head 16 for his or her swing characteristics.

Figure 12:
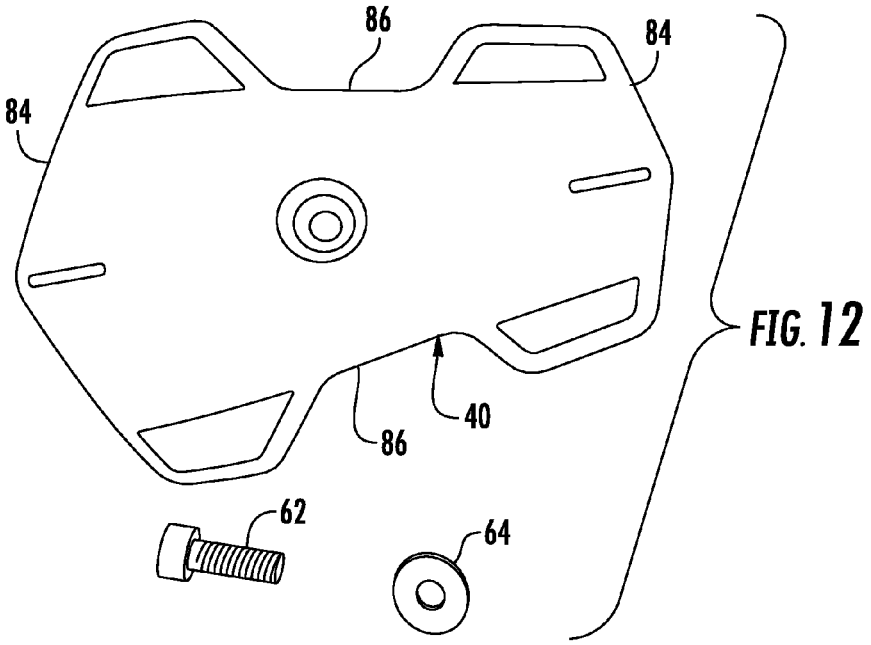
FIG. 12 is an exploded perspective view of an example sole plate and fastening arrangement of the example golf club head of FIG. 1.
Figure 13:
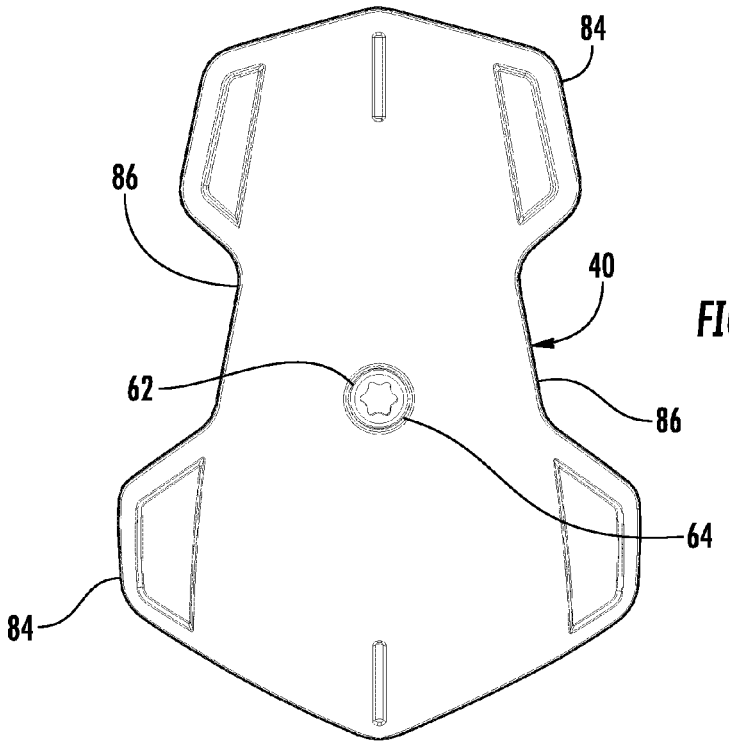
FIG. 13 is a bottom view of the example sole plate and fastening arrangement of FIG. 12.
Figure 14:
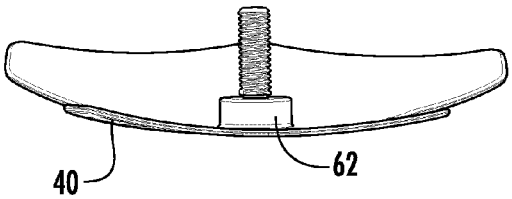
FIG. 14 is a front view of the example sole plate and fastening arrangement of FIG. 13.
Figure 15:
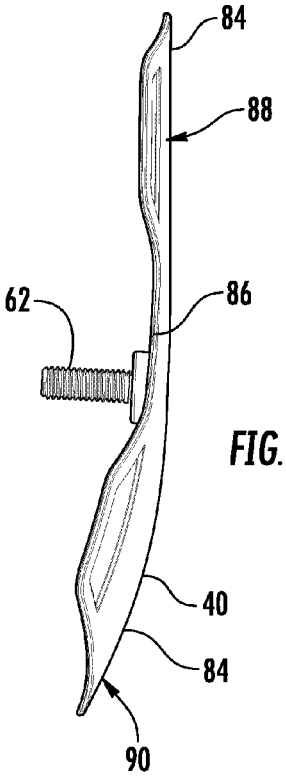
FIG. 15 is a side view of the example sole plate and fastening arrangement of FIG. 13.
Figure 16:
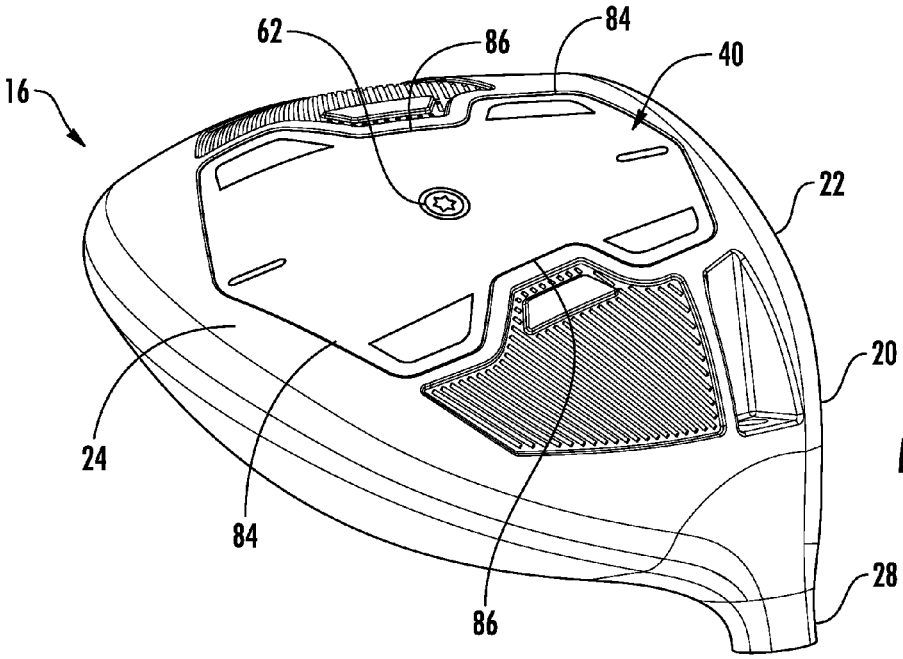
FIG. 16 is a bottom perspective view of the example sole plate mounted to the example sole of the example golf club head of FIG. 1, the sole plate being illustrated in a cover position.

Sole plate 40 assists in retaining weight slugs 46 within their respective weight ports 44. Sole plate 40 further covers and protects such weight slugs 46 and inhibits the collection of debris, dirt or grass in any unused weight ports 44. FIGS. 12-16 illustrates sole plate 40 in more detail. FIG. 12 is an exploded perspective view of sole plate 40 along with fastener 62 and washer 64. FIGS. 13-15 illustrate fastener 62 and washer 64 joined to sole plate 40. FIG. 16 illustrates sole plate 40 removably mounted to sole 24 by fastener 62, over weight ports 44 and any received weight slugs 46.

As shown by FIGS. 12 and 13, sole plate 40 comprises a non-circular plate. The non-circular shape of plate 40 facilitates rotation of plate 40 to provide access to weight ports 44 even while plate 40 remains attached or coupled to sole 24. In the example illustrated, sole plate 40 comprises a pair of opposite lobes 84 spaced by a narrower throat portion providing notches 86. Fastener 62 extends through sole plate 40 between lobes 84, between notches 86. As will be described hereafter, notches 86 facilitate access to weight ports 44 when sole plate 40 is rotated.

As shown by FIGS. 14 and 15, sole plate 40 has a shape or profile corresponding to the shape or profile of sole 24 and/or recess 42. In the example illustrated, sole plate 40 has a forward portion 88 that is substantially flat, extending towards front strike face 22 when sole plate 40 is mounted to sole 24. Sole plate 40 has a rearward portion 90 having an outer profile that corresponds to the upwardly curving surface of sole 24 as sole 24 extends towards the rear or tail of head 16. In other implementations, sole plate 40 may have other shapes and configurations depending upon the configuration of sole 24.

Figure 17:
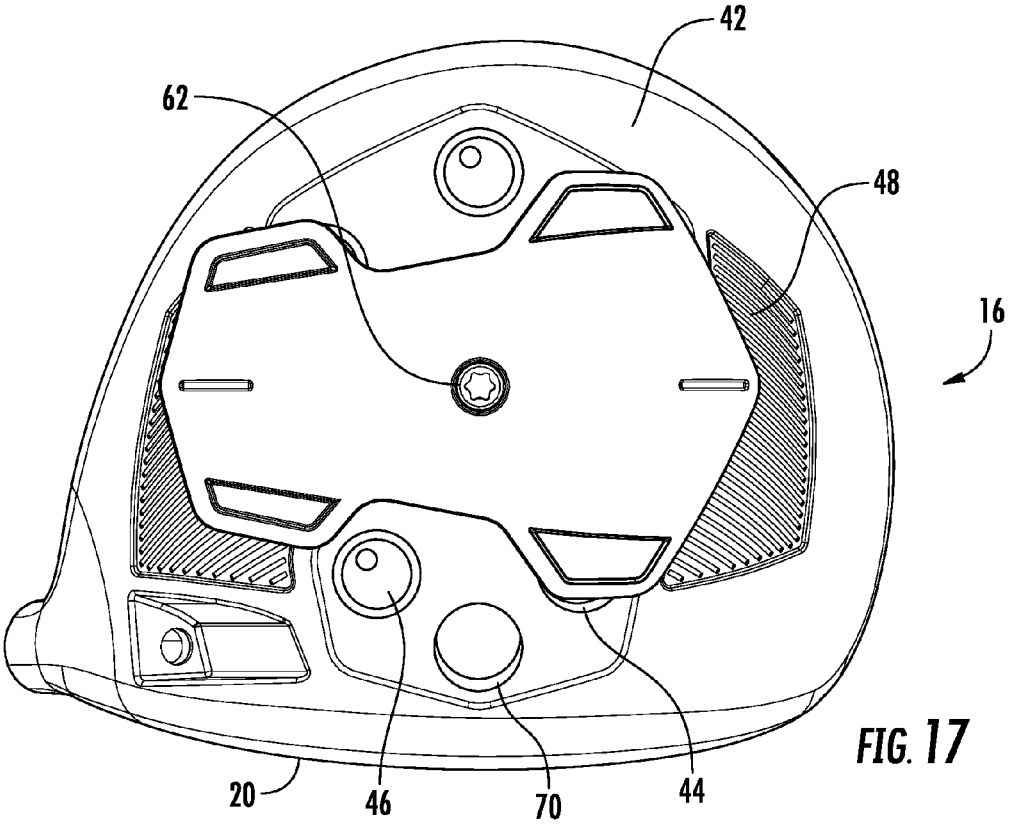
FIG. 17 is a bottom perspective view of the example sole plate of FIG. 16 with the sole plate rotated to a first example access position while remaining attached to the example sole.
Figure 18:
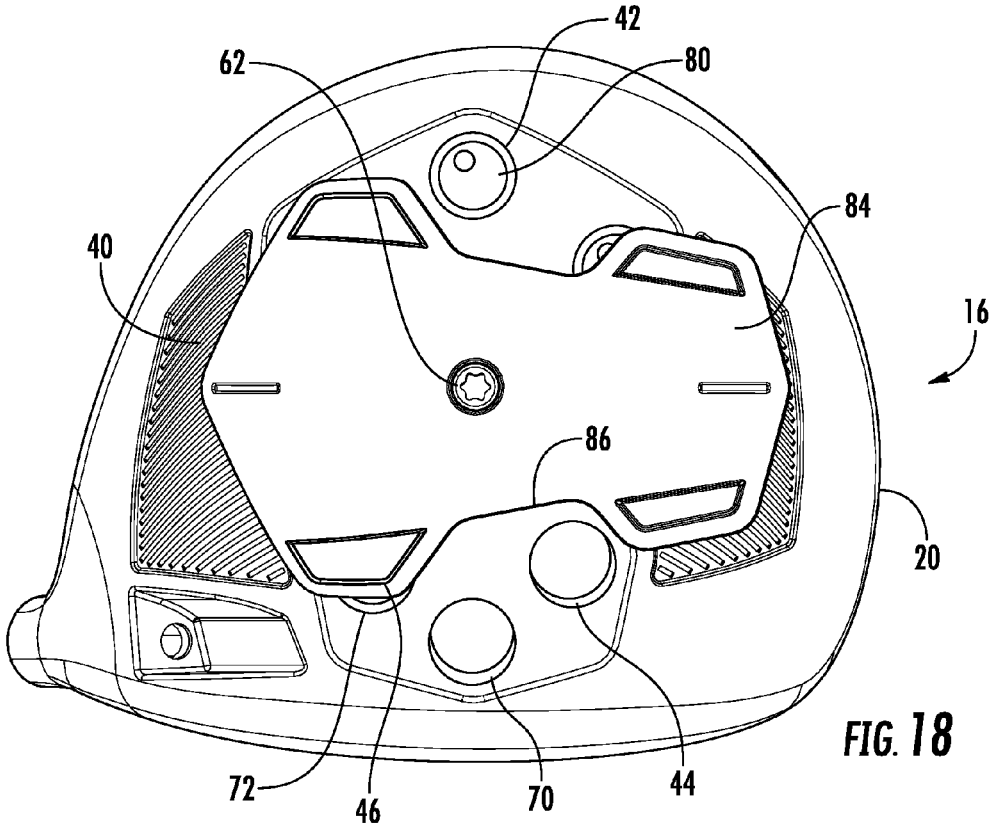
FIG. 18 is a bottom perspective view of the example sole plate of FIG. 16 with the sole plate rotated to a second example access position while remaining attached to the example sole.

FIGS. 17 and 18 illustrate rotation of sole plate 24, while remaining attached are coupled to sole 24, from the closed position shown in FIG. 16 to different access positions shown in FIGS. 17 and 18. In the closed position shown in FIG. 16, sole plate 40 completely covers and protects weight ports 44. In the different access positions shown in FIGS. 17 and 18, sole plate 40 exposes such weight ports 44 to a sufficient extent such that weight slugs 46 may be inserted into or withdrawn from the exposed weight ports 44.

FIG. 17 illustrates sole plate 40 rotated in a counterclockwise direction to a first access position in which center weight port 70 is exposed, allowing it weight slug to be inserted into or removed from center weight port 70. FIG. 18 illustrates sole plate 40 alternatively rotated in a clockwise direction to a second access position in which center weight port 70, side weight port 72 proximate to the heel of body 20 and center weight port 80 are exposed for the removal or insertion of weight slugs 46. FIG. 18 illustrates the side weight port 72 and the center weight port 80 being occupied with weight slugs 46. Selected rotation of sole plate 40 by different angular extents, all while so plate 40 remains coupled to sole 24, may expose each and every weight port 44, providing a user with full access to weight ports 44 without having to disconnect sole plate 40.

As further shown by FIG. 18, notches 86 provide enhanced access to weight ports 44 when sole plate 40 have been rotated to an access position. For example, in the access position shown in FIG. 18, both side weight port 72 and center weight port 80 are exposed and accessible through the opposite notches 86. Although sole plate 40 is illustrated as having two opposite notches 86 and two opposite lobes 84, in other implementations, sole plate 40 may alternatively comprise a single notch 86. Sole plate 40 may have various other shapes that allow rotation of sole plate 40 between a cover position and at least one access position.

In the example illustrated, sole plate 40 is completely removable from sole 24 by simply completely unscrewing fastener 62 from sole plate 24. The fastener 62 and the bore 56 are sufficiently sized to enable the fastener 62 to be loosened and unthreaded from the bore 56 by several revolutions without the fastener 62 separating or losing threaded engagement with the bore 56. The partially removed or partially unthreaded fastener 62 enables a sole plate 40 to be repositioned about the sole 24 of the body 20 such that one or more of the weight ports 44 and one or more of the weighted slugs 46 are selectively accessible for removal and/or insertion of one or more of the weighted slugs 46 into one or more different weight ports 52. The fastener 62 and bore 56 also enables the sole plate 40 to pivot about an axis defined by the fastener 62 and reposition the sole plate 40 into a second position that is rotated 180 degrees (or other angular positions, as desired by the user) from the original sole plate position.

Figure 19:
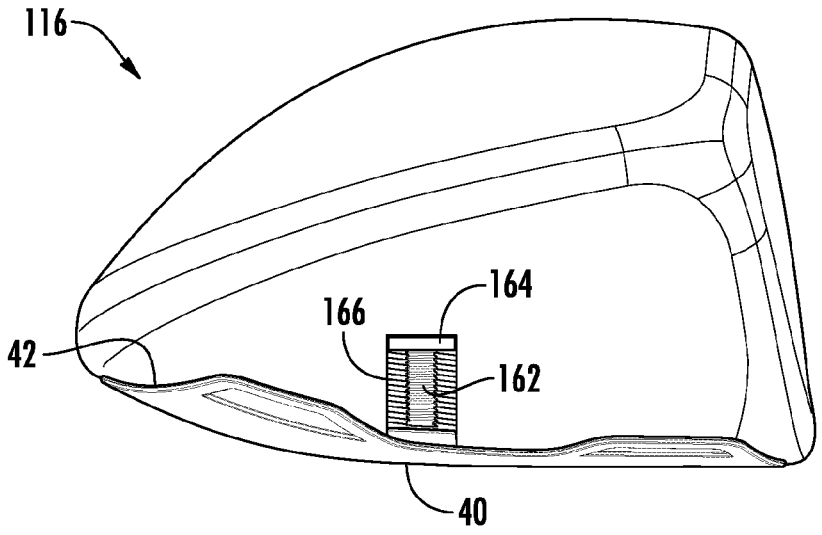
FIG. 19 is a side view of another example golf club head with portions transparently and illustrating an example sole plate in a recess received position.
Figure 20:
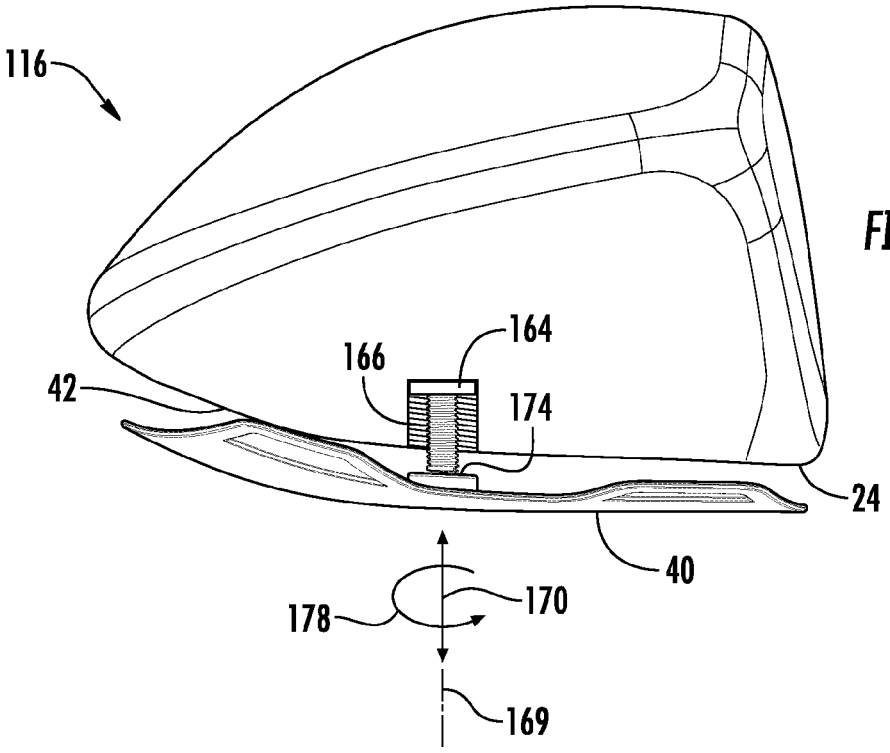
FIG. 20 is a side view of another example golf club head with portions transparently shown and illustrating the example sole plate in a recess withdrawn position.

In other implementations, sole plate 40 may be rotatably coupled to sole 24 of body 20 in other fashions. FIGS. 19 and 20 illustrate another example golf club head 116, an alternative implementation of golf club head 16. Golf club head 116 is similar to golf club head 16 except the golf club head 116 rotatably supports and is coupled to sole plate 40 with an alternative mechanism that facilitates movement of sole plate 40 directly away from sole 24 in the direction indicated by arrow 170 (shown in FIG. 20) without rotation of sole plate 40. In one implementation, sole plate 40 is permanently coupled to sole 24 in that sole plate 40 cannot be completely decoupled or disconnected from sole 24 without damage to golf club head 16 or its components. In other implementations, sole plate 40 is additionally removably coupled to sole 24.

In the example illustrated, in lieu of fastener 62 and washer 64, golf club head 116 comprises post 162, head 164 and spring 166. Post 162 comprise a cylindrical or polygonal shaft extending through an opening 174 in sole 24 with a first end fixed or otherwise secured to sole plate 40 and a second end fixed otherwise formed as a part of head 164. Post 162 facilitates movement of sole plate 40 relative to sole 24 in the direction indicated by arrows 170 without rotation. Head 164 limits the extent to which sole plate 40 may be withdrawn or spaced from sole 24.

Spring 166 comprise a compression spring captured between head 164 and the interior floor of sole 24. Spring 166 resiliently biases had 164 in an upward direction so as to resiliently biased sole plate 40 towards sole 24. As shown by arrows 178 in FIG. 20, once sole plate 40 has been lowered, against the bias provided by spring 166, away from sole 24, out of recess 42, sole plate 40 may be rotated about axis 169 from the cover position in which sole plate 40 is aligned with recess 42 to a misaligned position in which sole plate 40 is out of alignment with recess 42, exposing portions of recess 42. Appropriate degrees of rotation of sole plate 40 may move sole plate 40 to an access position, exposing at least one weight port 44 for the insertion or removal of a weight slug 46.

Once a weight slug 46 has been removed from a corresponding weight port 44 and/or a weight slug 46 has been inserted into a selected one of weight ports 44, sole plate 40 may once again be rotated to a cover position, in alignment with recess 42, but possibly spaced from recess 42. Thereafter, sole plate 40 may be released, wherein spring 166 resiliently moves or draws sole plate 40 back into recess 42 and in abutment with sole 24. As should be appreciated, in some implementations, sole plate 40 may be rotated out of alignment with recess 42 while sole plate 40 is out of alignment with recess 42 and is contacting or bearing against sole 24.

Although head 116 is illustrated as utilizing a compression spring to resiliently biased sole plate 40 towards sole 24 while allowing sole plate 40 to be pulled away from sole 24 and out of recess 42 for rotation from a cover position to an axis position, in other implementations, other spring mechanisms may be employed. For example, a tension spring may also be employed to resiliently bias sole plate 40 towards sole 24.

Figure 21:
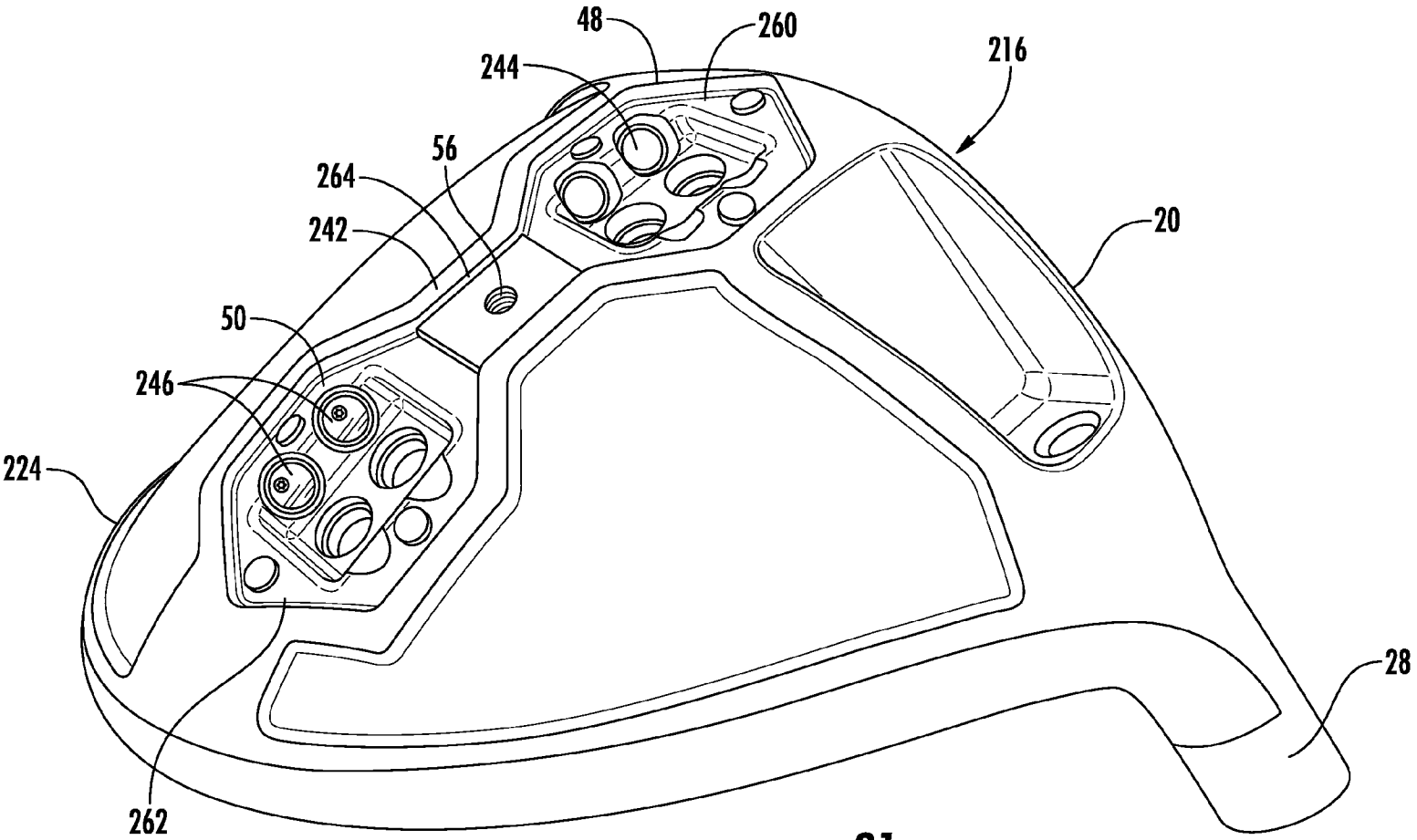
FIG. 21 is a bottom perspective view of another example golf club head without an attached sole plate.
Figure 22:
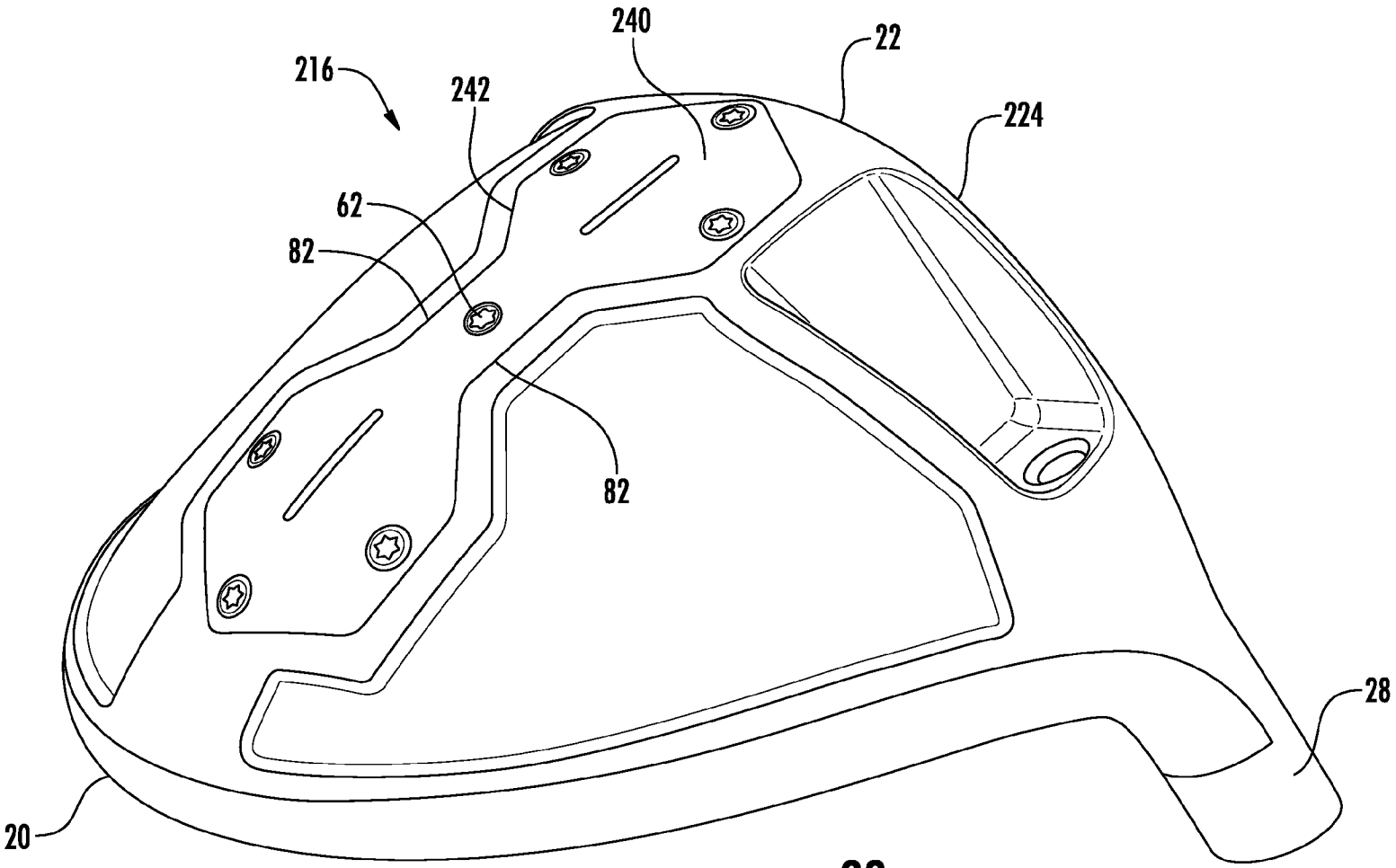
FIG. 22 is a bottom perspective view of the example golf club head of FIG. 21 with an example sole plate in a cover position.
Figure 23:
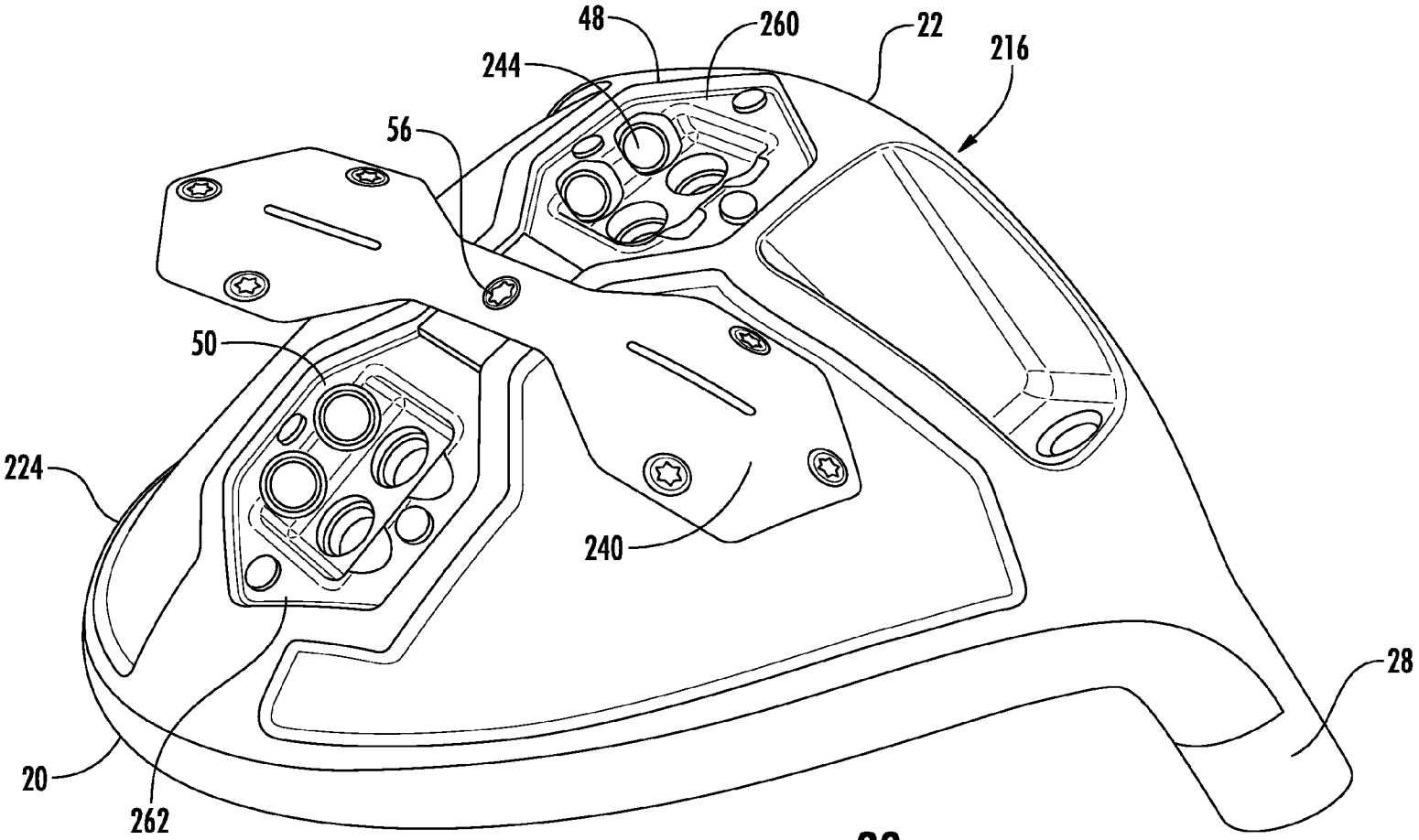
FIG. 23 is a bottom perspective view of the example golf club head of FIG. 22 with the example sole plate in an access position.

FIGS. 21-23 illustrate golf club head 216, another alternative implementation of golf club head 16. Golf club head 216 is similar to golf club head 16 except that golf club head 216 comprises an alternative sole 224 and an alternative sole plate 240. Those remaining components or elements of golf club head 216 that correspond to components or elements of golf club head 16 are numbered similarly.

Sole 224 of head 216 is similar to sole 24 of head 16 except that sole 224 comprises recess 242 and weight ports 244. Recess 242 extends into the bottom of sole 224 and has a shape so as to correspond to the shape and receive sole plate 240. Recess 244 comprises a pair of opposite recess lobes, a front recess lobe 260 and a rear recess lobe 262, spaced by a narrow or intermediate throat portion 264.

Weight ports 244 are similar to weight ports 44 described above except that weight ports 244 have a different layout. Weight ports 244 comprise a grid of weight ports in each of the front recess lobe 260 in the rear recess lobe 262. In the example illustrated, comprise a grid of four equally spaced and similarly sized weight ports 244. In other implementations, head 216 may comprise additional or fewer of such weight ports 244 in each of the lobes 260, 262. Weight ports 244 may have other layouts within each of lobes 260, 262. The weight ports 244 are angled with respect to a vertical longitudinal plane perpendicularly extending from the strike plate 22. The angle of the weight ports in relation to a vertical plane can range from 0 (parallel to the vertical plane) to 45 degrees. In other implementations, the angle of the weight ports can extend from 5 to 30 degrees with respect to the vertical plane. Weighted slugs 246 are similar to weight slugs 46 described above except that weight slugs have a different diameter and length. In another implementation, the weight ports can consist of a cylindrical side wall or a stepped cylindrical side wall without a bottom or end surface. In such an implementation, the weighted slugs 246 can engage the cylindrical side wall of the weight port 244 and extend equal to or beyond the length of the weight port 244 such that the end of the weighted slug 246 is suspended within the hollow body of the the club head 16.

FIG. 22 illustrates sole plate 240 in a cover position, within recess 242, extending over each of weight ports 244 and any weight slugs, such as weight slugs 46, received therein. Sole plate 240 operates in a fashion similar to sole plate 40 when a user desires to change the weight characteristics of golf club head 216. In particular, fastener 262 may be rotated to be loosened and unthreaded from the bore 56 by several revolutions without the fastener 62 separating or losing threaded engagement with the bore 56. The partially removed or partially unthreaded fastener 62 enables a sole plate 240 to be repositioned about the sole 224 of the body 20 such that one or more of the weight ports 244 and one or more of the weighted slugs 46 are selectively accessible for removal and/or insertion of one or more of the weighted slugs 46 into one or more different weight ports 52. The fastener 62 and bore 56 also enables the sole plate 240 to pivot about an axis defined by the fastener 262 and reposition the sole plate 240 into a second position that is rotated 180 degrees from the original sole plate position.

As shown by FIG. 23, due to the dual lobe shape of recess 242 and sole plate 240, as well as the concentration of weight ports 244 and each of the two spaced recess lobes 260, 262, sole plate 240 may be rotated to a single access position in which all of weight ports 244 in each of recess lobes 260, 262 are concurrently accessible. In particular, sole plate 240 may be rotated to a position in which plate 240 extends substantially parallel to front strike face 22, leaving recess lobes 260 and 262 uncovered. Notches 82 in sole plate 240 provide further enhanced access to the weight ports 244 within recess lobes 260 and 262. In some implementations, notches 82 may be omitted with the single access position of sole plate 240 providing acts to all of the weight ports 244 in each of recess lobes 260, 262.

The disclose features of the golf clubs and golf club heads provide numerous advantages over existing golf clubs. The weights and sole plates can be easily, simply and conveniently removed, replaced and/or adjusted to obtain a number of different golf club characteristics. The weights and sole plates optimize the adjustability and customization of the club head. The assembly performs well, and allows for the player to quickly and easily adjust the club head to match the golfer's particular needs or objectives at that time. The present assembly also can be readily adjusted into a variety of different settings thereby eliminating the need for the golfer to carry multiple clubs to meet the different desired settings. Further, the present invention provides a golf club that meets these needs while also providing an improved, pleasing aesthetic. The adjustment assembly is also configured for use in competitive play including tournament play by satisfying the requirements of The Rules of Golf as approved by the U.S. Golf Association and the Royal and Ancient Golf Club of St. Andrews, Scotland effective Jan. 1, 2012 ("The Rules of Golf"). Accordingly, the term "assembly is configured for organized, competitive play" refers to a golf club head that fully meets the golf shaft rules and/or requirements of The Rules of Golf.

While the example embodiments have been illustrated and described, it will be appreciated that various changes can be made therein without departing from the spirit and scope of the disclosure. For example, although different example embodiments may have been described as including one or more features providing one or more benefits, it is contemplated that the described features may be interchanged with one another or alternatively be combined with one another in the described example embodiments or in other alternative embodiments. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is defined in this specification, the terminology used in the present specification is intended to be interpreted in its broadest reasonable manner, even though may be used conjunction with the description of certain specific embodiments of the present disclosure.

What is claimed is:

1. A golf club head comprising:

a body comprising:

a hosel portion;

a front strike face;

a crown; and a sole comprising a floor and sidewalls extending from the floor to the crown, the floor comprising weight ports for receiving weighted slugs; and a sole plate rotatably mounted to the sole by a centrally positioned sole plate coupling member, the sole plate being rotatable about an axis of the sole plate coupling member that extends through the sole and the crown of the body, while remaining mounted to the sole, between a cover position in which the sole plate covers each of the weight ports and at least one access position in which each and every weighted port is accessible for removal or insertion of a weighted slug, the sole plate including a pair of opposing lobes spaced by a narrower throat portion, one of the lobes being larger than the other of the lobes.

2. The golf club head of claim 1, wherein the weight ports comprise at least six weight ports.

3. The golf club head of claim 1, wherein the weight ports are asymmetrically arranged about the axis.

4. The golf club head of claim 3, wherein the weight ports comprise:

a first cluster of weight ports proximate the front strike face on a first side of the axis, the weight ports of the first cluster having a first spacing in a direction along the front strike face; and a second cluster of weight ports on a second side of the axis opposite the first side, the second cluster of weight ports having a second spacing in the direction along the front strike face, the second spacing being greater than the first spacing.

5. The golf club head of claim 4, wherein each of the weight ports of the first cluster and the second cluster have a diameter of at least 10 mm.

6. The golf club head of claim 4, wherein the first cluster of weight ports comprises:

a first weight port along a longitudinal centerline of the body extending substantially perpendicular to the front strike face, the first weight part having a first outer perimeter;

a second weight port laterally offset from the first weight port on a first side of the longitudinal centerline, the second weight port having a second outer perimeter overlapping the first outer perimeter in a lateral direction; and a third weight port laterally offset from the first weight port on a second side of the longitudinal centerline, the third weight port having a third outer perimeter overlapping the first outer perimeter in the lateral direction.

7. The golf club head of claim 6, wherein the second cluster of weight ports comprises:

a fourth weight port along the longitudinal centerline of the body, the fourth weight port having a fourth perimeter;

a fifth weight port laterally offset from the fourth weight port on the first side of the longitudinal centerline, the fifth weight port having a fifth outer perimeter laterally offset from and longitudinally overlapping the first outer perimeter; and a sixth weight port laterally offset from the fourth weight port on the second side of the longitudinal centerline, the sixth weight port having a sixth outer perimeter laterally offset from and longitudinally overlapping the second outer perimeter.

8. The golf club head of claim 1, wherein the floor comprises a recess in which the weight parts are located and wherein the sole plate is rotatable, while remaining mounted to the sole, between an aligned position in which the sole plate is aligned with the recess and a misaligned position in which the sole plate is misaligned with respect to the recess.

9. The golf club head of claim 8, wherein the sole plate, when in the aligned position, is movable between a received position in which the sole plate is received within the recess and a withdrawn position in which the sole plate is withdrawn from the recess.

10. The golf club head of claim 9, wherein the sole plate is resiliently biased towards the received position.

11. The golf club head of claim 1, wherein the sole plate comprise a notch, wherein at least one of the weight ports is accessible through the notch in response to the sole plate being rotated to an access position.

12. The golf club head of claim 11 further comprising a second notch opposite the first notch.

13. The golf club head of claim 1, wherein the sole plate is screwed to the sole.

14. The golf club head of claim 1 further comprising a set of weight slugs, each weight slug of the set being receivable within at least one of the weight ports, each weight slug comprising:

a slug body;

a first elastomeric gasket on an exterior of the slug body to grip a first interior surface of one of the weight ports at a first depth when received within said one of the weight ports; and a second elastomeric gasket on the exterior of the slug body to grip a second interior surface of said one of the weight ports at a second depth, greater than the first depth, when received within said one of the weight ports.

15. The golf club head of claim 14, wherein the set of weight slugs comprises:

a first weight slug having a first weight; and a second weight slug having a second weight different than the first weight.

* * * * *